US006808613B2

(12) United States Patent
Beauvir

(10) Patent No.: US 6,808,613 B2
(45) Date of Patent: Oct. 26, 2004

(54) OXIDIZING ELECTROLYTIC METHOD FOR OBTAINING A CERAMIC COATING AT THE SURFACE OF A METAL

(76) Inventor: Jacques Beauvir, 12 rue Guillaume Fichet, 74000 Annecy (FR)

( * ) Notice: Subject to any disclaimer, the term of this patent is extended or adjusted under 35 U.S.C. 154(b) by 66 days.

(21) Appl. No.: 10/018,709

(22) PCT Filed: Apr. 25, 2001

(86) PCT No.: PCT/FR01/01269

§ 371 (c)(1),
(2), (4) Date: Mar. 27, 2002

(87) PCT Pub. No.: WO01/81658

PCT Pub. Date: Nov. 1, 2001

(65) Prior Publication Data

US 2002/0112962 A1 Aug. 22, 2002

(51) Int. Cl.[7] ..... C25D 11/02

(52) U.S. Cl. ..... 205/106; 204/229.5; 204/230.6; 205/107; 205/108; 205/321; 205/322; 205/324; 205/333

(58) Field of Search ..... 205/106, 107, 205/108, 316, 321, 322, 324, 333; 204/229.5, 230.2, 230.6

(56) References Cited

U.S. PATENT DOCUMENTS

| | | | | |
|---|---|---|---|---|
| 4,468,293 A | * | 8/1984 | Polan et al. | 428/612 |
| 4,923,574 A | * | 5/1990 | Cohen | 205/83 |
| 5,071,527 A | * | 12/1991 | Kauffman | 205/786 |
| 5,141,602 A | * | 8/1992 | Chen et al. | 205/103 |
| 5,147,515 A | * | 9/1992 | Hanagata et al. | 204/164 |
| 5,605,615 A | * | 2/1997 | Goolsby et al. | 205/83 |
| 5,616,229 A | | 4/1997 | Samsonov et al. | |
| 5,705,230 A | * | 1/1998 | Matanabe et al. | 427/438 |
| 5,720,866 A | | 2/1998 | Erokhine et al. | |
| 6,197,178 B1 | * | 3/2001 | Patel et al. | 205/81 |

FOREIGN PATENT DOCUMENTS

| | | |
|---|---|---|
| DE | DD 257 274 | 6/1988 |
| WO | WO 99 31303 | 6/1999 |

OTHER PUBLICATIONS

Database WPI, Section Ch, Week 199527, Derwent Publications Ltd., London, GB, Class M AN 1995–205092, XP002158795, Nov. 30, 1994.
Database WPI, Section Ch, Week 199731, Derwent Publications Ltd., London, GB, Class LO AN 1997–340324, XP002158793, Dec. 20, 1996.
Database WPI, Section Ch, Week 199342, Derwent Publications Ltd., London, GB, Class M AN 1993–334616, XP002158796, Oct. 7, 1992.
Database WPI, Section Ch, Week 199532, Derwent Publications Ltd., London, GB, Class M AN 1995–246412, XP002158794, Jul. 6, 1995.

* cited by examiner

*Primary Examiner*—Roy King
*Assistant Examiner*—William T. Leader
(74) *Attorney, Agent, or Firm*—Cantor Colburn LLP

(57) ABSTRACT

Process for obtaining a ceramic coating on the surface of a metal having semiconducting properties, such as aluminium, titanium, magnesium, hafnium, zirconium and their alloys, by a physico-chemical transformation reaction of the treated metal. This process consists in immersing the metal workpiece to be coated in an electrolytic bath composed of an aqueous solution of an alkali metal hydroxide, such as potassium hydroxide or sodium hydroxide, and of an oxyacid salt of an alkali metal, the metal workpiece forming one of the electrodes, and in applying a signal voltage of overall triangular waveform to the electrodes, that is to say a signal having at least a rising slope and a falling slope, with a form factor that can vary during the process, generating a current which is controlled in its intensity, its waveform and its ratio of positive current to negative current.

10 Claims, 4 Drawing Sheets

OXIDIZING ELECTROLYTIC METHOD FOR OBTAINING A CERAMIC COATING AT THE SURFACE OF A METAL

TECHNICAL FIELD

The subject of the present invention is an electrical oxidation process using a microarc plasma for the purpose of obtaining a ceramic coating on the surface of a metal having semiconducting properties.

Aluminium, titanium, their alloys and all metals which exhibit valve (diode) properties have a beneficial strength/weight ratio and are suitable for a wide range of applications such as in aeronautics, automobiles and mechanical engineering (especially for moving parts, with high mechanical loads and strains), etc.

BACKGROUND OF THE INVENTION

However, as these materials do not naturally exhibit suitable tribological and mechanical properties (hardness, friction coefficient, abrasion resistance, etc.), coatings are often used to improve the limited characteristics of the coatings on these materials.

They often allow complementary requirements to be met, such as the corrosion resistance in acid medium and/or alkaline medium, the possibility of momentarily withstanding high temperatures, or the obtaining of dielectric properties.

Several electrolytic coating processes are currently employed. The process most used, for wear and/or corrosion protection, is hard anodizing. However, this quite rapidly reaches its operating limits.

This anodizing process is used to form protective oxide layers on aluminium workpieces. However, the coatings produced by this method are limited in terms of thickness and have only a moderate hardness (a maximum of about 500 Hv).

A number of other techniques have been developed to produce coatings of higher performance, especially ceramic coatings, so as to meet severer operating requirements, namely arch-discharge plasma spraying, flame spraying or vacuum deposition techniques.

However, the drawback is that, to obtain good adhesion of the coating, these techniques require a high substrate temperature and prior processes for preparing the surface.

Moreover, these processes cannot compete with conventional anodizing in terms of coating uniformity and/or production costs.

A relatively old (1932) anodic oxidation process using anodic spark discharges or microarc discharges has been developed so as to obtain ceramic coatings for workpieces made of aluminium, titanium, magnesium and their alloys, as a means of protection against severe abrasion and corrosion.

Owing to the valve effect, microarc oxidation forms an insulating barrier film on the metals such as aluminium and titanium. By increasing the anodic potential to more than 200 V, the barrier film is broken and microarcs appear. If a high voltage is maintained, many microarcs are initiated and they move rapidly over the entire immersed surface of the specimen.

These dielectric breakdowns create tracks which pass through the oxide (barrier) layer formed. Complex compounds are synthesized within these tracks. They are composed of substrate material, surface oxides and addition elements from the electrolyte. Chemical interactions in the plasma phase occur in the multiple surface discharges and result in the formation of a coating which grows in two directions from the surface of the substrate. This causes a gradual change in the composition of the properties of the coating from the metal alloy within the substrate to a complex ceramic compound in the coating.

According to the historical description of this process, Gunterschulze and Betz were the first to mention, in 1932, the anodic spark deposition (ASD) process. They observed that the material underwent deposition of the electrolyte during the dielectric breakdown of an insulating film growing on the anode.

This dielectric breakdown causes sparks which appear and disappear while being distributed over the entire surface of the anode, giving the effect of movement.

The first practical applications of ASD were their use as anticorrosion coatings on magnesium alloys, dating from 1936, and these were included in a military specification in 1963.

Since then, the main research efforts have been pursued by Gruss, McNeill and coworkers at the Frankford Arsenal in Philadelphia, and by Brown, Wirtz, Kriven and coworkers at the University of Illinois in Urbana-Champaign.

At the same time, research was carried out in East Germany, mainly by Krysmann, Kurze, Dittrich and coworkers. The German process is called "anodic oxidation by spark discharges" (the German acronym for which is ANOF [Anodische Oxidation an Funkenanladung]). The reports of this work in the international literature make reference to patents in the German language.

It is clear that this research has made significant progress, yet it remains, despite everything, superficial and the compounds of the coating formed have not been clearly identified (only the $\alpha$-$Al_2O_3$ and $\gamma$-$Al_2O_3$ (OH) (bohemite) have been identified by X-ray diffraction).

One process, patented in 1974, was developed in order to compete with coatings on aluminium for architectural purposes. The method allows the aluminium substrate to act as an anode in a potassium silicate solution so that an aluminosilicate coating of olive-grey colour is applied by using a 400 V half-wave rectified DC current. The process takes place by dielectric breakdown of the barrier layer, causing sparks or scintillations visible on the anodic substrate, while Bakovets, Dolgoveseva and Nikoforova postulate three parallel mechanisms during formation of the film, namely electrochemical, plasma oxidation and chemical oxidation mechanisms.

Several modifications have been made to this process, called "silicodisant", comprising the addition of carboxylic acids and of vanadium components in the bath. Ceramic or tetrafluoroethylene resins have also been added to the bath so as to provide the coating with hardness or lubrication properties.

The drawback with such processes is the use, in terms of signal waveform, of a DC current of a few mA at voltages of less than 500 V. This results in the sparking being stopped after a few minutes (most of the deposit is formed in the first few minutes). Such operating conditions make it possible to produce only very small coating thicknesses and thus limit its physical properties.

Other processes describe the use, in electrolytic baths of variable composition, of AC voltages which may exceed 1000 V combined with a DC or AC current.

It should also be noted that the use in certain cases of high voltages with high current densities means that these processes cannot easily be exploited on an industrial scale.

On the other hand, the excellent adhesion to the substrate of this type of coating, the physical and tribological characteristics (high hardness, thermal resistance, electrical resistance, abrasion resistance, corrosion resistance, etc.), the wide variety of aluminosilicate mixtures for coating purposes and the fact that the coating can be performed within narrow surfaces of complex geometry are among the many advantages of this process.

We describe below a different type of microarc process capable of monitoring, imposing and controlling the change in a ceramic coating process in its various phases. A suitable device is used to achieve optimum programming according to various parameters (nature of the alloy or of the metal of the workpieces to be treated, characteristics of the ceramic that it is desired to obtain, etc.).

Three main process phases may be identified, according to the descriptions that may be found in the numerous scientific works and other publications on the subject generally called microarc oxidation and described above.

The workpieces to be treated and the electrodes immersed in the electrolyte constitute a dipole, to which the electrical energy delivered by a generator is applied.

The electrolyte is an aqueous solution, preferably based on demineralized water, and includes at least one oxyacid salt of an alkali metal and a hydroxide of an alkali metal. A wide variety of solutions are described in the numerous publications on the subject.

In the first phase, which lasts from a few seconds to a few minutes depending on the alloys, an insulating layer consisting of a hydroxide is formed, this thin layer being a dielectric.

In the second phase, breakdown of this dielectric layer is observed with microarc activity which increases with the electrical energy applied.

According to the aforementioned parameters, this second phase lasts between 15 and 30 minutes.

The third phase sees the gradual formation of a thick ceramic layer. The composition and the physical properties of the coating change during this formation. The predominant presence of components of the $\gamma$-$Al_2O_3$ (bohemite) and $\alpha$-$Al_2O_3$ (corundum) have been identified by X-ray diffraction.

When a generator delivering DC or AC electrical power with fixed parameters is used, a drop in the current during the process is observed, with differentiation of the voltage versus current curves recorded on the oscilloscope.

This is the result of the process itself, independently of any intervention. In this case, one of the key factors is the dielectric property and the thickness of the ceramic layer formed.

The generators used and described in the various publications deliver either a rectified and/or DC current or a sinusoidal single-phase or three-phase AC current. Series-connected capacitors are interposed, especially to limit the current in the secondary operating circuit and a particular waveform of the current ensues. Also described are AC generators supplied with three-phase current and using the three phases sequentially by means of thyristors or equivalent electronic devices. The waveform of the current is merely the result of the process itself and its shape cannot be modified.

Document U.S. Pat. No. 5,616,229 relates to a process for producing a ceramic coating by this technique, in which the voltage applied to the electrodes is at least 700 V. Below this voltage value, it is not possible to obtain a coherent ceramic, but rather a powder. There is therefore a very high energy consumption, especially when the workpieces to be coated with ceramic have a large area.

An electrolyte process is provided for plasma microarc oxidation for the purpose of obtaining a ceramic coating on the surface of a metal workpiece having semiconducting properties, such as aluminium, titanium, magnesium, hafnium, zirconium and their alloys by a physico-chemical transformation reaction of the treated metal. The porosity of the ceramic layer is decreased, obtaining a very dense and uniformly thick layer over the entire surface of the workpiece. Furthermore, the time to grow the ceramic on the surface of the metal workpiece is reduced, while decreasing the electrical energy consumed.

For this purpose, the process of the invention is characterized in that it consists in:

immersing the metal workpiece to be coated in an electrolytic bath composed of an aqueous solution of an alkali metal hydroxide, such as potassium hydroxide or sodium hydroxide, and of an oxyacid salt of an alkali metal, the metal workpiece forming one of the electrodes; and applying a signal voltage of overall triangular waveform to the electrodes, that is to say a signal having at least a rising slope and a falling slope, with a form factor that can vary during the process, generating a current which is controlled in its intensity, its waveform and its ratio of positive intensity to negative intensity.

It is thus possible to tailor the voltage waveform to the various steps of the process as well as to the type of alloy and to the various electrolytic bath solutions. This waveform has, in addition and jointly, a frequency-variable parameter. This improves to a great extent the quality of the ceramic coating compared with that obtained by known processes.

Various methods of implementing this process are possible. Thus, the rising and falling slopes of the voltage signal may be approximately symmetric or asymmetric and have angles which vary during the process. It is also possible, during the process, to make the frequency of the triangular signal change between about 100 and 400 Hz.

According to one method of implementing this process, it consists in making the value of the triangular voltage change during the electrolysis between about 300 and 600 Vrms.

The value of the current may also be modified or fixed independently of the voltage. The various parameters (the form factor, the value of the potential, the frequency, the value of the current and the UA/IC ratio) may be modified simultaneously or independently of one another during the process.

According to another of these characteristics, this process consists in separately controlling its waveforms and the electrical power VI values in the positive phase and/or in the negative phase.

An electronic generator of the current source type for implementing this process, comprising a unit for connection to a single-phase or three-phase electrical supply from the mains and a unit for connection to the electrolysis tank, is characterized in that it comprises:

a module for converting the sinusoidal AC signal delivered by the mains into a trapezoidal or sawtooth signal;

a module for modifying the slope and the form factor of the signal;

a module for varying the frequency in various types of cycle; and a module for managing the electrical energy according to the parameterized energy and the energy used.

Advantageously, this generator includes, at the output, an isolating transformer with series-connected capacitors in the primary or the secondary, in order to filter the DC component so as to prevent the magnetic circuit from saturating, while introducing optimum operating safety in respect of electrical protection, with connection of one of the poles to earth.

According to another characteristic of the invention, this generator is controlled by a PC-type processor used to manage the various parameters during execution of the process.

The conjugate variations in the frequency, voltage and form factor of the signal and of the current play an essential role in the process according to the invention.

The frequency scan conjugate with the variations in the rising slope of our triangular signal makes it possible to excite, in turn, internal regions which are not very active and external regions having high levels of natural excitation.

The steep rising slope makes it possible to induce microarc initiation very actively without a rise in the mean voltage. The gentle slope maintains a constant current for the time needed to carry out the physico-chemical reaction within the plasma. Controlling the falling slope also has repercussions on the negative current. The negative current peak helps to diffuse the Al ions needed for continuity of formation of the ceramic layer in certain phases of the process. It also serves to reduce the residual porosity at the end of the process.

Symmetric slopes of the signal favour a rapid and uniform growth of the ceramic layer and allow the inclusion of additive elements that can be added to the bath, according to the characteristics of the ceramic coating that it is desired to obtain for the optimum use of the workpieces.

This situation is much more effective than that obtained using a sinusoid or a DC current described in the documents of the prior art.

Implementation of the process according to the invention has the following main advantages:

optimum formation of the hydroxide layer;

significant reduction in the roughness of the surface of the layer;

improvement in the adhesion of the coating to the substrate;

progressive growth of the oxide layer;

rapid growth of the ceramic layer of the $\alpha$-$Al_2O_3$ (corundum) type;

capability of effective control and reduction of the residual level of porosity inherent in the basic microarc process itself, and above all with certain alloys;

improvement in the treatment on highly alloyed aluminium grades;

formation of a thicker and denser layer in a time reduced by more than half (50%);

capability of restarting the microarcs in the advanced phase of the treatment in order to obtain greater thicknesses from 40 $\mu$m to 300 $\mu$m (depending on the alloys) without destruction of the existing layer;

reduction in the energy consumption by more than 50%;

reduction in the thermal power emitted by a factor of 35%;

better homogeneity obtained apart from the current creep paths due to the corners and the contours of the workpieces to be treated; and possibility of impregnating, under vacuum, by dipping, by spraying or other means, an elastomeric polymer resin or other organic compound.

For an identical compared capacity per $dm^2$ of area treated, it is possible with this new process to use a 50% smaller supply cable cross section.

The energy power of the mains which delivers the electrical supply is reduced in the same proportions along with the fixed meter band charge for the electrical energy consumed.

It follows that there is a major saving and a substantial reduction in the manufacturing cost of the treatment, with increased quality. Knowing that one of the main industrial drawbacks lies in such high electrical energy consumption, the current process already provides a major advantage in this field.

From another standpoint, this same plant is capable, based on a certain value of electrical energy, of doubling the treatment capacity compared with a conventional generator using the sinusoidal signal of the distribution mains. The voltage versus current curves obtained show the fundamental differences in the positive and negative energy peaks obtained by the process. Complete control of these parameters means that it is possible to obtain the desired current values and waveforms at whatever step in the growth of the layer during the treatment.

BRIEF DESCRIPTION OF THE DRAWINGS

The invention is explained below with reference to the appended schematic drawing showing one embodiment of the apparatus for implementing the process, together with a few curves illustrating the process.

DETAILED DESCRIPTION OF THE PREFERRED EMBODIMENT

Figure 1:
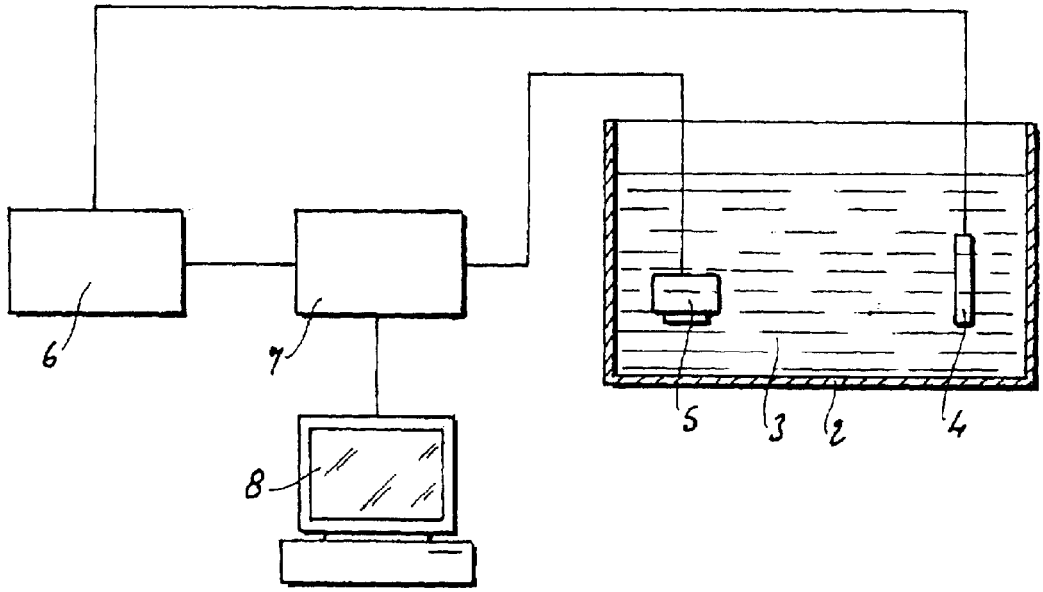
FIG. 1 is a very general view of the plant.

FIG. 1 illustrates the overall arrangement of a plant in which the tank is denoted by the overall reference 2 and contains an electrolytic bath 3 consisting of an aqueous solution of an alkali metal hydroxide, such as potassium hydroxide or sodium hydroxide, or of an oxyacid salt of an alkali metal. Immersed in the electrolyte are a counterelectrode (cathode) 4 and an "anode" 5 which consists of the workpiece to be coated by transformation of the metal itself, this workpiece being made of a metal or metal alloy having semiconducting properties. Also shown in FIG. 1 are a current supply unit 6, a voltage generator 7 and a microcomputer 8 controlling and monitoring the parameters that vary according to the sequences of the process.

Figure 2:
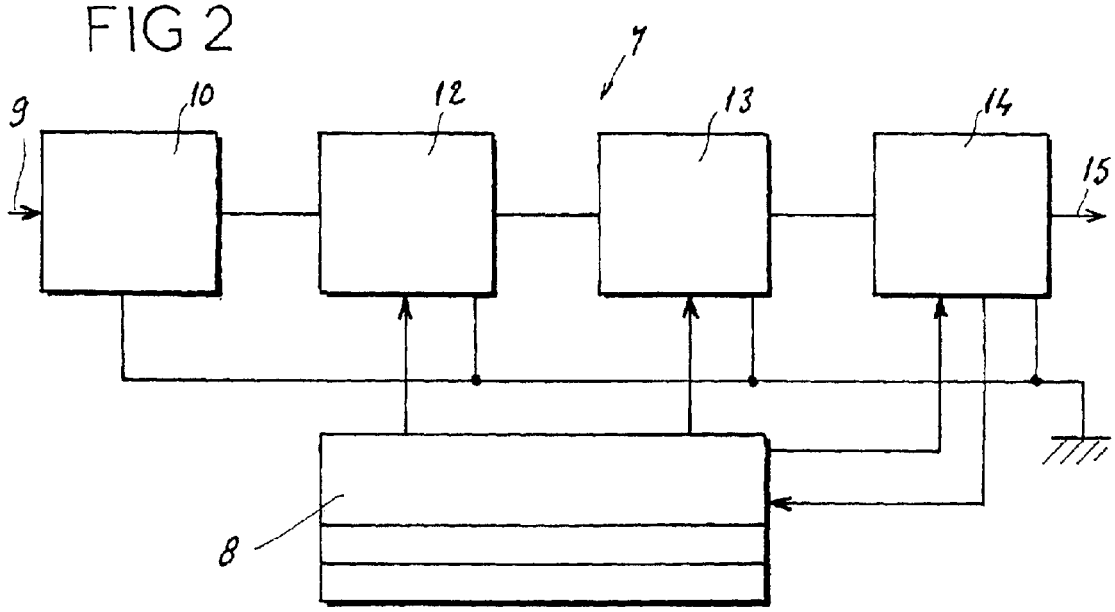
FIG. 2 is a block-diagram view of the current generator.
Figure 3:
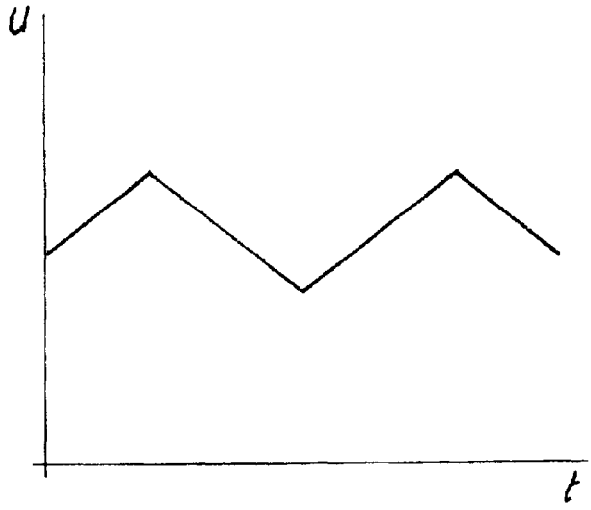
FIGS. 3, 4 and 5 are three illustrative diagrams of the feed voltage signal when this is balanced, of the corresponding current/voltage signal taken at the terminals of the load and the positive and negative power curves relating thereto, respectively.
Figure 4:
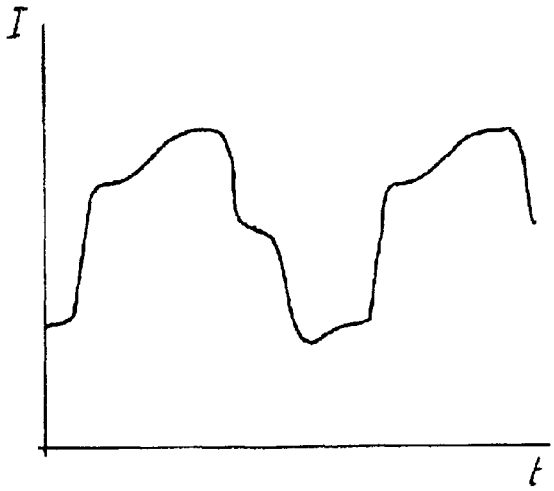
Figure 5:
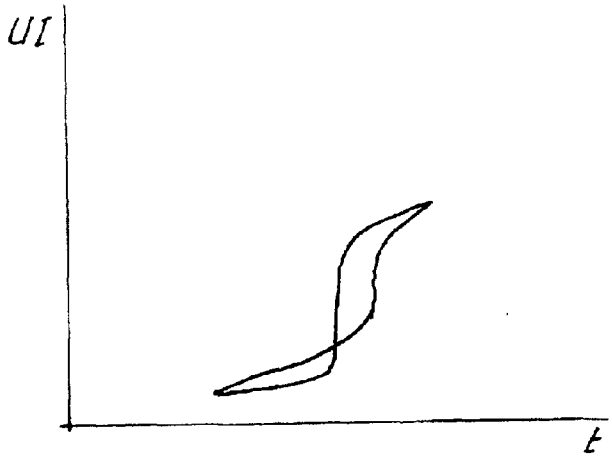
Figure 6:
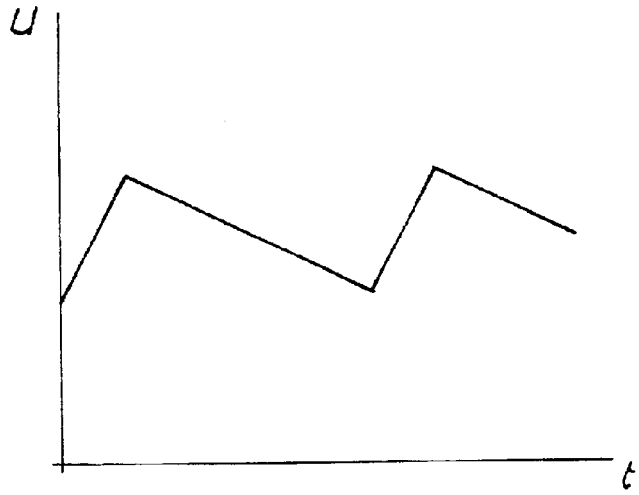
FIGS. 6, 7 and 8 are three views corresponding to FIGS. 3, 4 and 5, respectively, when the rising slope of the voltage signal is steeper than the falling slope.
Figure 7:
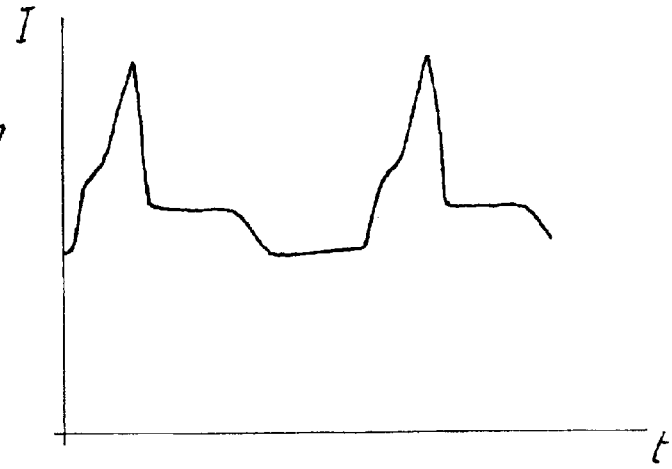
Figure 8:
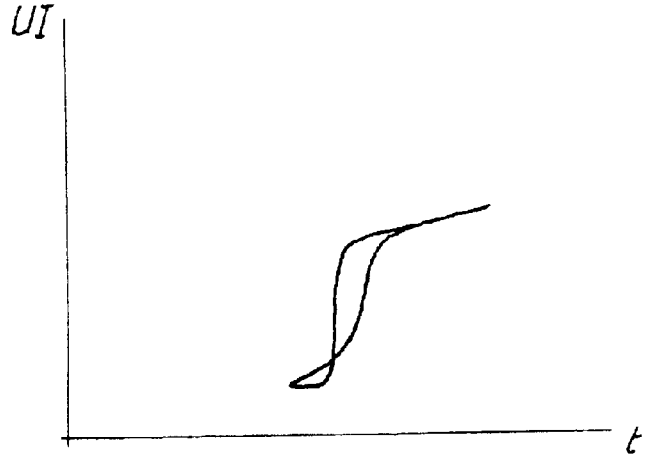
Figure 9:
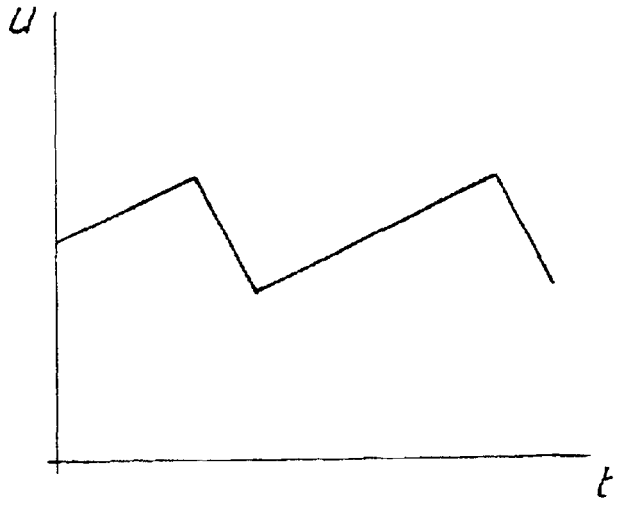
FIGS. 9, 10 and 11 are three views corresponding to FIGS. 3, 4 and 5, respectively, when the falling slope of the voltage signal is steeper than the rising slope.
Figure 10:
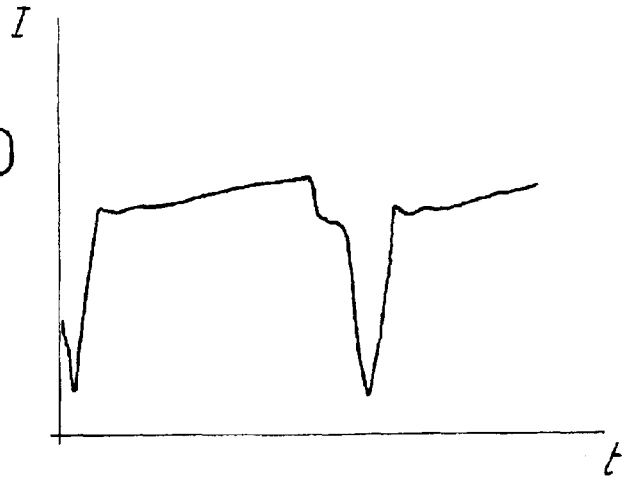
Figure 11:
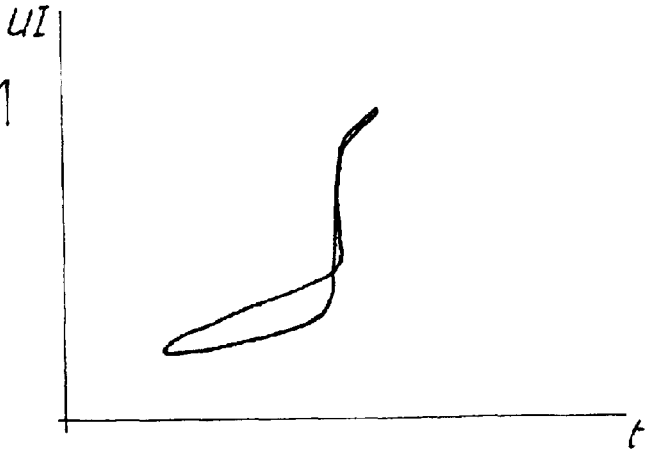

FIG. 2 shows the generator 7 in greater detail. The power is supplied in the left part of FIG. 2, at the place denoted by the reference number 9. This generator comprises a module 10 for converting the sinusoidal AC periodic signal 50 into a triangular or trapezoidal signal. The module 12 is intended to modify the slope and the form factor of the voltage signal. The module 13 controls the variation in the frequency in various types of cycle, for example from 70 to 400 Hz.

The module 14 connected to the microcomputer 8 manages the electrical energy according to the parameterized energy and the energy actually used. The output signal is denoted by the reference number 15. It is possible for it to include, at the output, an isolating transformer, not shown, with series-connected capacitors in the primary or the secondary, in order to filter the DC component so as to prevent the magnetic circuit from saturating, while introducing optimum operating safety in respect of electrical protection, with connection of one of the poles to earth.

The curves illustrated in FIGS. 3 to 11 clearly show the consequences of the variation in the rising and falling slopes of the voltage signal, especially on the electrical power and on the distribution of the positive and negative phases thereof. It is worth pointing out that the power is easily adjusted by varying the rising and falling slopes of the voltage signal.

As is apparent from the foregoing, the invention offers a great improvement in the existing technique by providing a very inexpensive operating process making it possible to deposit a ceramic coating of uniform thickness and of excellent quality on metal workpieces, even of large area.

what is claimed is:

1. Electrolytic process for plasma microarc oxidation for obtaining a ceramic coating on a surface of a metal having semiconducting properties by a physico-chemical transformation reaction of the treated metal, comprising:

immersing the metal in an electrolytic bath composed of an aqueous solution of an alkali metal hydroxide and an oxyacid salt of an alkali metal, the metal forming an electrode;

applying a signal voltage of overall triangular waveform to the electrode, having at least a rising slope and a falling slope, with a form factor that can vary during the process, generating a current which is controlled in intensity, waveform and ratio of positive intensity to negative intensity; and varying the form factor, a value of a potential, a frequency and a value of a current, independently during the process.

2. Process according to claim 1, wherein the rising and falling slopes of the voltage signal are approximately symmetric.

3. Process according to claim 1, wherein the rising and falling slopes of the voltage signal are asymmetric and have angles which vary during the electrolysis.

4. Process according to claim 1, further comprising making the value of the triangular voltage change between 300 and 600 Vrms during the process.

5. Process according to claim 1 further comprising making the frequency of the triangular signal vary between 100 and 400 Hz during the process.

6. Process according to claim 1, further comprising separately controlling the waveforms and electrical power values VI in a positive phase and/or in a negative phase.

7. Process according to claim 1, wherein the metal is selected from the group comprising aluminum, titanium, magnesium, hafnium, zirconium and alloys of the same.

8. Process according to claim 1, wherein the aqueous solution is potassium hydroxide or sodium hydroxide.

9. Electrolytic process for plasma microarc oxidation for obtaining a ceramic coating on a surface of a metal having semiconducting properties by a physico-chemical transformation reaction of the treated metal, comprising:

immersing the metal in an electrolytic bath composed of an aqueous solution of an alkali metal hydroxide and an oxyacid salt of an alkali metal, the metal forming an electrode; and applying a signal voltage of overall triangular waveform to the electrode, having at least a rising slope and a falling slope, with a form factor that can vary during the process, generating a current which is controlled in intensity, waveform and ratio of positive intensity to negative intensity; and making the frequency of the triangular signal vary between 100 and 400 Hz during the process.

10. Electrolytic process for plasma microarc oxidation for obtaining a ceramic coating on a surface of a metal having semiconducting properties by a physico-chemical transformation reaction of the treated metal, comprising:

immersing the metal in an electrolytic bath composed of an aqueous solution of an alkali metal hydroxide and an oxyacid salt of an alkali metal, the metal forming an electrode; and applying a signal voltage of overall triangular waveform to the electrode, having at least a rising slope and a falling slope, with a form factor that can vary during the process, generating a current which is controlled in intensity, waveform and ratio of positive intensity to negative intensity; and varying the form factor, a value of a potential, a frequency, a value of a current and the UA/IC ratio, simultaneously during the process.

* * * * *